US006815400B2

(12) United States Patent
Jee et al.

(10) Patent No.: US 6,815,400 B2
(45) Date of Patent: Nov. 9, 2004

(54) METHOD FOR FORMING SOLID FILM LUBRICANT

(75) Inventors: Yong-jun Jee, Daejeon (KR); Ki-hong Kim, Daejeon (KR); Kyoung-jun Yang, Seoul (KR)

(73) Assignee: Halla Climate Control Corp. (KR)

( * ) Notice: Subject to any disclaimer, the term of this patent is extended or adjusted under 35 U.S.C. 154(b) by 207 days.

(21) Appl. No.: 10/159,017

(22) Filed: Jun. 3, 2002

(65) Prior Publication Data

US 2002/0183209 A1 Dec. 5, 2002

(30) Foreign Application Priority Data

Jun. 4, 2001 (KR) ..... 2001-31121

(51) Int. Cl.[7] ..... C10M 125/02; C10M 125/22

(52) U.S. Cl. ..... 508/113; 508/155; 508/167; 508/181; 427/180; 427/190; 427/328; 428/543

(58) Field of Search ..... 427/180, 190; 508/113

(56) References Cited

U.S. PATENT DOCUMENTS

| | | | | |
|---|---|---|---|---|
| 3,051,586 A | | 8/1962 | Heath et al. | 428/328 |
| 3,146,142 A | | 8/1964 | Maly | 156/91 |
| 3,626,043 A | | 12/1971 | Flipot | 264/37.29 |
| 3,878,113 A | | 4/1975 | Campbell et al. | 508/108 |
| 4,088,585 A | | 5/1978 | Karpen | 508/141 |
| 4,206,060 A | | 6/1980 | Yamamoto et al. | 508/118 |
| 4,303,537 A | | 12/1981 | Laepple et al. | 508/118 |
| 4,473,381 A | | 9/1984 | Winter | 95/115 |
| 4,479,669 A | | 10/1984 | Hynes | 285/332.3 |
| 4,808,324 A | | 2/1989 | Periard et al. | 508/115 |
| 5,240,741 A | * | 8/1993 | Edwards et al. | 427/180 |
| 5,358,753 A | * | 10/1994 | Rao et al. | 427/451 |
| 5,363,821 A | * | 11/1994 | Rao et al. | 123/193.2 |
| 5,408,964 A | * | 4/1995 | Rao | 123/193.2 |
| 5,482,637 A | * | 1/1996 | Rao et al. | 508/100 |
| 5,484,662 A | * | 1/1996 | Rao | 428/553 |
| 5,538,649 A | * | 7/1996 | Demendi et al. | 508/101 |
| 5,554,020 A | * | 9/1996 | Rao et al. | 418/178 |
| 5,638,600 A | * | 6/1997 | Rao et al. | 29/888.02 |
| 5,958,847 A | * | 9/1999 | Novak | 508/156 |
| 6,485,780 B1 | * | 11/2002 | Sangeeta et al. | 427/180 |
| 6,528,143 B1 | * | 3/2003 | Adam et al. | 428/141 |

FOREIGN PATENT DOCUMENTS

| | | |
|---|---|---|
| EP | 0 496 503 A | 7/1992 |
| EP | 0 617 118 A | 9/1994 |
| JP | 61-004797 | 1/1986 |
| JP | 04-026777 | 1/1992 |

* cited by examiner

*Primary Examiner*—Ellen M. McAvoy
(74) *Attorney, Agent, or Firm*—Lowe Hauptman; Gilman & Berner LLP

(57) ABSTRACT

A method for forming a solid film lubricant on the surface of a part having an arbitrary shape is provided, comprising preparing a carrier having a predetermined shape and size; coating lubricant powder on the carrier; and coating the lubricant powder over the surface of the part by physical contact between the carrier coated with the lubricant powder and the part.

19 Claims, 15 Drawing Sheets

METHOD FOR FORMING SOLID FILM LUBRICANT

BACKGROUND OF THE INVENTION

1. Field of the Invention

The present invention relates to a method for preparing a solid film lubricant with superior lubricity for parts of machinery that operate under conditions of extremely high stress.

2. Description of the Related Art

Solid film lubricants are necessary for long-lasting lubrication of machinery parts, dry lubrication under special conditions such as high-temperature and high-vacuum conditions, and for material surfaces having particular functional properties such as improved abrasion resistance and lowered friction of the surfaces coated with the lubricants, etc. In recent years, interests in solid film lubricant related technology are growing in the mechanical and electronic industries with wide applications for office machinery, vehicles, vacuum apparatuses, food processing apparatuses, precision apparatuses, printing machines, aerospace related apparatuses, chemical related equipment, etc.

As an example, when a bearing is operated under high-load, high-temperature, or vacuum conditions, a lubricant film coated on the bearing surface is damaged, causing galling by heat generated by direct contact between metals. In particular, common aqueous lubricants are inadequate to provide lubrication in a vacuum environment or at extremely low or high temperatures. In addition, when operation of a piece of liquid lubricated machinery is halted, the aqueous lubricant undesirably flows down off of the surfaces where it is needed due to gravity, thereby causing trouble and potential damage when restarting the machinery.

To avoid such problems, in prior art, a coating mixture of a lubricant material, such as graphite, molybdenum disulfide ($MoS_2$), tungsten disulfide ($WS_2$), polytetrafluoroethylene (PTFE), or boric nitride (BN), and a binding agent such as an organic or inorganic compound is used. A solid film lubricant is formed on a pretreated target part by spraying in air or by sputtering of the coating mixture in a vacuum chamber. U.S. Pat. No. 4,473,381 discloses a lubricant film which is capable of effectively preventing galling of sliding metallic parts. The lubricant film comprises 60–80% by weight molybdenum disulfide or molybdenum disulfide and graphite, 10–30% by weight additive for improved thermal stability and anti-oxidation, such as antimony oxide ($Sb_2O_3$), iron (Fe) powder, zinc (Zn) powder, or gold (Au) powder, and an organic binder such as epoxy-ester resin, acrylic resin or urea resin. Other molybdenum disulfide-resin based lubricants are disclosed in U.S. Pat. Nos. 3,051,586; 4,303,537; 3,146,142; and 4,206,060.

Japanese Patent Publication No. hei 4-26777 discloses a method for forming a solid film lubricant with improved thermal resistance and lubrication on a titanium (Ti) or titanium alloy plate. Prior to deposition of the solid film lubricant on the surface of a base metal, heating at 500° C. in a vacuum and chemical activation are carried out on the base metal as pre-treatments to attain a porous surface. The base metal with the porous surface is electroplated with a composite material such as nickel-phosphate or silicon-carbide, thereby improving thermal resistance and durability. Japanese Patent Publication No. sho 61-4797 discloses a method of coating a molybdenum-epoxy resin based film lubricant on the surface of a metal part by thin spraying of a dispersion of molybdenum disulfide and epoxy resin in a solvent after degreasing the surface of the metal part.

However, for the solid film lubricant formation using the coating material including organic or inorganic binders described above, it is difficult to accurately control a ratio of the solid lubricant and the binder as well as the thickness of the solid film lubricant, thereby leading to a problem of non-uniform thickness, which can be serious for precision parts. In addition, additional post-processes, such as lapping of the solid film lubricant, need to be performed. In this case, aside from difficulties in processing, there is a limitation in lapping the thickness of the remaining solid film lubricant to an appropriate level.

Meanwhile, a pigment used as a lubricant in the solid film lubricant has a great specific gravity and oil absorbency so that it is very likely to settle down if it is used in the form of a coating mixture along with a resin. Therefore, it is difficult to determine an optimal ratio of the pigment serving as a lubricant and the resin serving as a binder. The greater the content of resin in the solid film lubricant, the worse the lubricity. The greater the content of pigment, the better the lubricity, but the worse the durability. To make up for the drawbacks of the solid film lubricant formed by spraying, a method for forming a solid film lubricant by sputtering, which is a kind of dry coating, has been suggested and applied for a variety of parts commonly used in the aerospace, defense, and high-precision industries. The processing costs are very high due to costly equipment used for the sputtering and slow sputtering rate. Therefore, the solid film lubricant formation by sputtering cannot be applied to commonly used parts.

SUMMARY OF THE INVENTION

It is an object of the present invention to provide a method for forming a long-lasting solid film lubricant with uniform thickness, which can be applied to parts of any shape without using resin as a binding agent.

To achieve the object of the present invention, there is provided a method for forming a solid film lubricant on the surface of a part having an arbitrary shape, the method comprising: preparing a carrier having a predetermined shape and size; coating lubricant powder on the carrier; and coating the lubricant powder over the surface of the part by physical contact between the carrier coated with the lubricant powder and the part.

It is preferable that the carrier coated with the lubricant powder and the part are made to contact physically each other by application of mechanical force selected from the group consisting of rotational, vibrational, frictional and impulsive forces. It is preferable that the lubricant power comprises at least one selected from the group consisting of molybdenum disulfide ($MoS_2$), tungsten disulfide ($WS_2$), graphite, boric nitride (BN), and polytetrafluoroethylene (PTFE). It is preferable that, in coating lubricant powder on the carrier, an organic or an inorganic binder is coated along with the lubricant powder on the carrier.

It is preferable that the solid film lubricant formation method further comprises forming at least one intermediate layer on the surface of the part for improved adhesion to the lubricant powder, before causing contact between the carrier coated with the lubricant powder and the part. It is preferable that the intermediate layer is formed of at least one material selected from the group consisting of silver, copper, tin, lead, gold, zinc, cadmium, an alloy of these metals, and a composite alloy of a solid lubricant and these metals. It is preferable that the intermediate layer is formed by at least one method selected from the group consisting of electroplating, chemical plating, vacuum plating, thermal spraying, and physicochemical deposition. The method preferably further comprises heating the part with the intermediate layer at a temperature of 150–500° C. for improved ductility of the intermediate layer, after forming the intermediate layer.

BRIEF DESCRIPTION OF THE DRAWINGS

The above object and advantages of the present invention will become more apparent by describing in detail preferred embodiments thereof with reference to the attached drawings in which.

DETAILED DESCRIPTION OF THE INVENTION

To overcome the drawbacks of a conventional coating of a solid film lubricant containing resin as a binder, the present inventors have developed a new method of coating a part with a solid film lubricant. According to the new solid film lubricant coating method, lubricant powder is uniformly coated on the surface of a carrier, which can be selected depending on the shape and material of a target part that needs the solid film lubricant, and the coating of lubricant powder on the carrier surface is physically transferred to the surface of the target part, for example, by application of mechanical force such as vibrational, rotational, frictional or impulsive force.

In particular, initial uniform deposition of lubricant powder on the surface of an appropriate carrier is followed by application of mechanical force, such as vibrational, rotational, frictional or impulsive force, to allow infiltration and uniform attachment of the lubricant powder to the surface of the target part, thereby resulting in a thin and uniform solid film lubricant. Because the solid film lubricant does not include any additives such as resin as a binder, the solid film lubricant has better lubricity than a conventional coating type solid film lubricant. The lubrication effect of the solid film lubricant is theoretically similar to that of a solid film lubricant formed by sputtering.

Formation of a solid film lubricant according to the present invention can be applied to a variety of target parts having different shapes and sizes using different kinds of coating equipment and suitable carriers.

Figure 1:
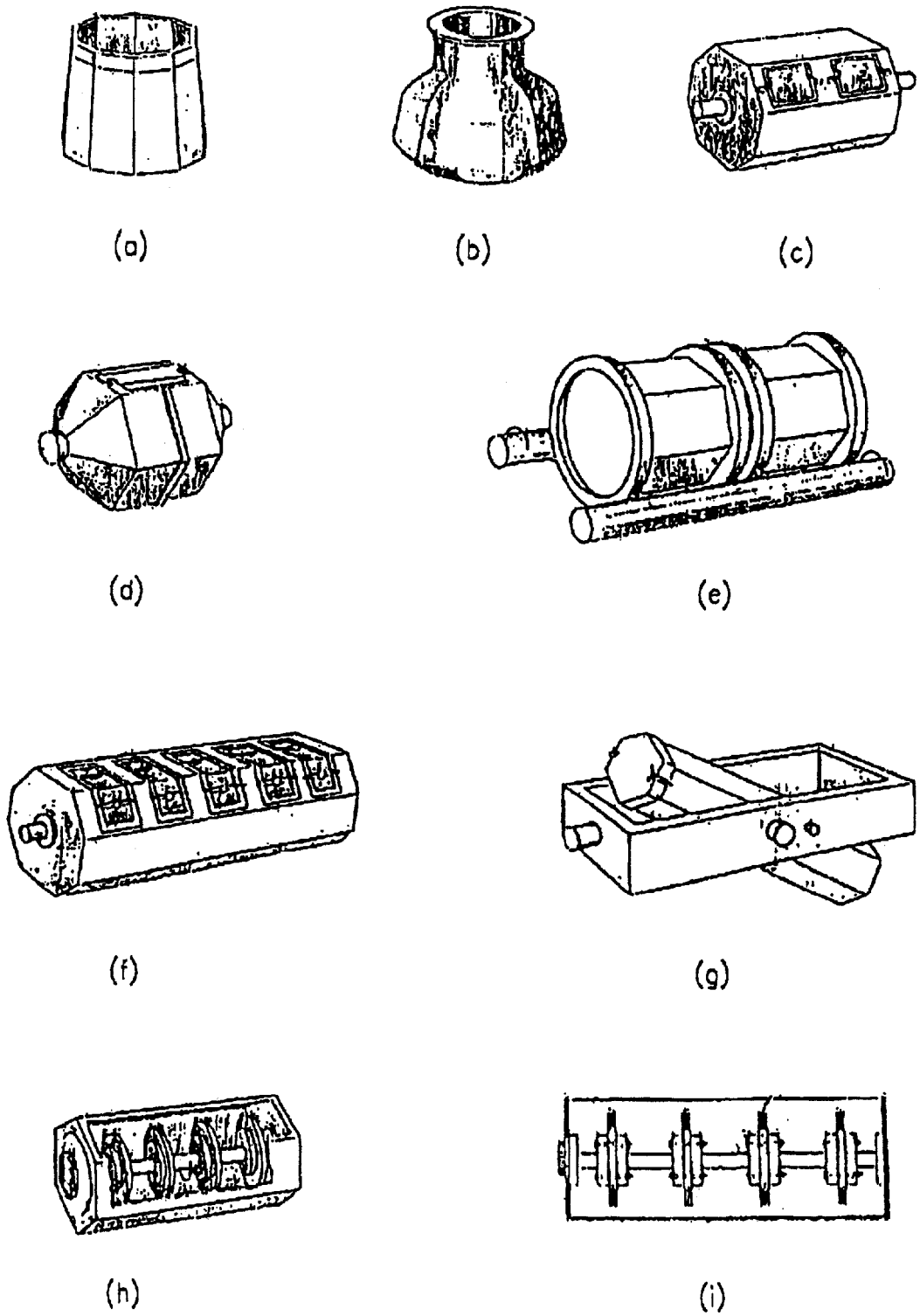
FIG. 1 shows a variety of barrels of different shapes.
Figure 2:
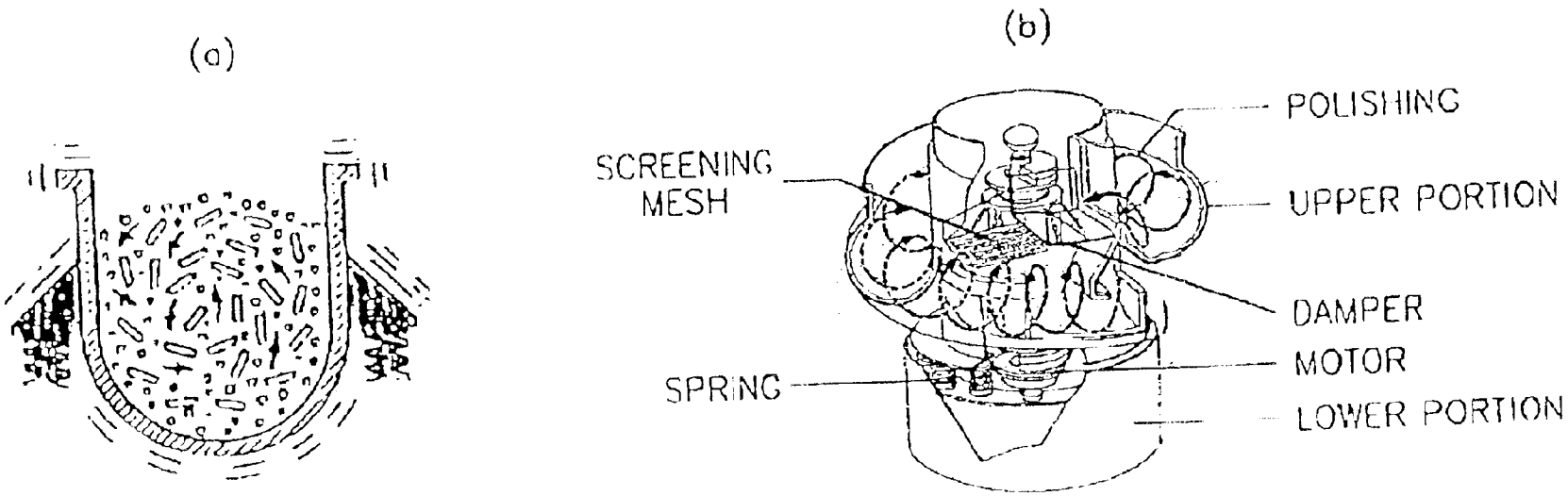
FIG. 2 shows the structures of vibrating barrels.
Figure 3:
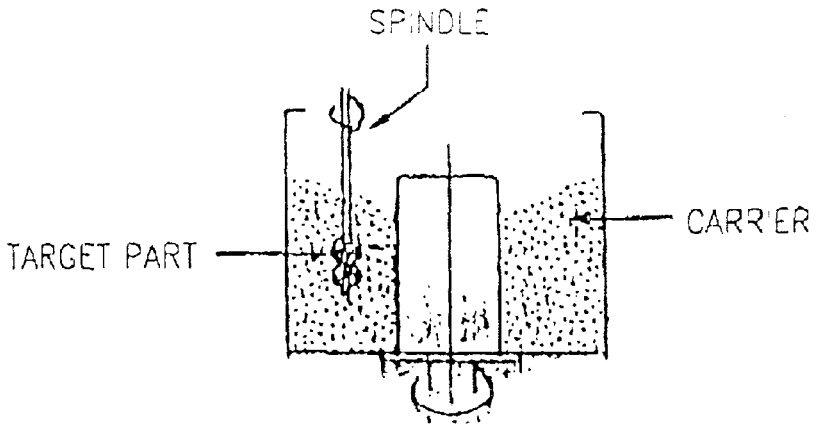
FIG. 3 shows the structure and operation of a gyro-finishing machine.

For example, useful coating equipment includes rotary barrels having a variety of shapes, as shown in FIG. 1, vibrating barrels, as shown in FIG. 2, and a gyro-finishing machine, which is used for a special purpose, as shown in FIG. 3.

Coating equipment is usually selected according to the shape of a target part. For small parts having simple shapes, which need not be carefully protected from damage from impact during a coating process, ordinary rotary barrels (a) through (g) of FIG. 1, or vibrating barrels (a) and (b) of FIG. 2 are used. For relatively large parts that would be damaged during a coating process, jigs (h) and (i) of FIG. 1, or the gyro-finishing machine of FIG. 3 is preferably used. Vibrating barrels cause higher frictional energy between a part and carrier, compared to common rotary barrels, thereby reducing coating time and improving adhesion of the coated layer to the part.

Figure 4:
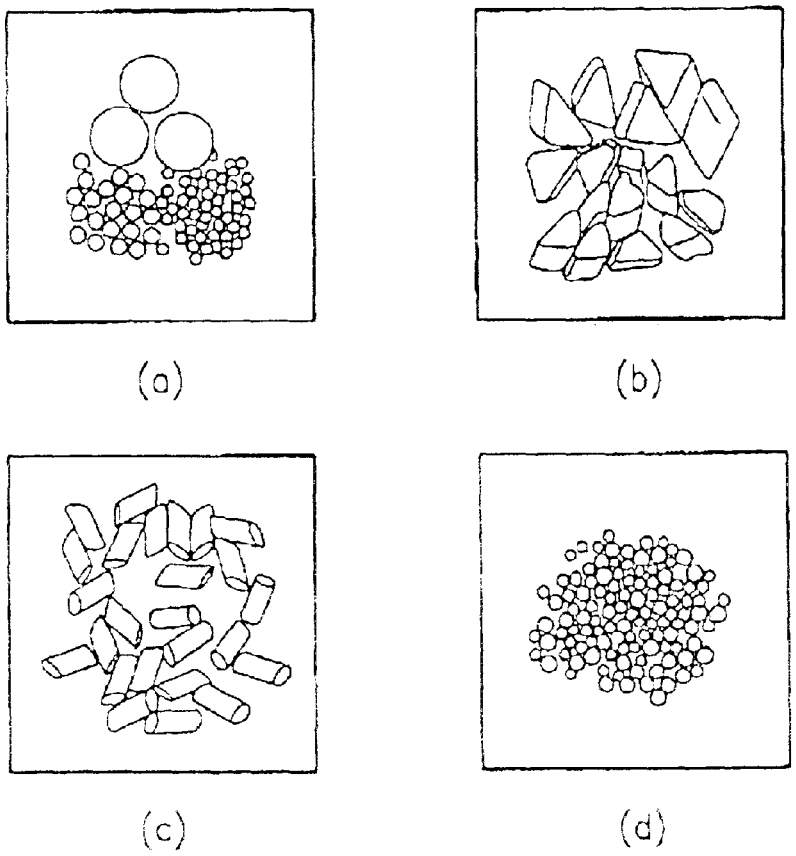
FIG. 4 shows a variety of available carriers.

A variety of carriers, as shown in FIG. 4, which are formed of different materials in different shapes and sizes, are available. Suitable materials for the carrier, which must be very hard and have very smooth surfaces, include sintered alumina, glass beads, and metals such as a stainless steel. The size or shape of the carrier is determined depending on the contour shape of a target part. Preferred examples of carrier for the solid film lubricant formation according to the present invention are shown in FIG. 4. In FIG. 4, carriers (a) through (c) are sintered alumina. Here, the shapes of the carriers may be spherical or non-spherical with a size of 1–5 mm. The shapes and sizes of the carriers can be selected depending on the shape of a target part. Carrier (d) of FIG. 4 is glass beads having a relatively large particle size.

Figure 5:
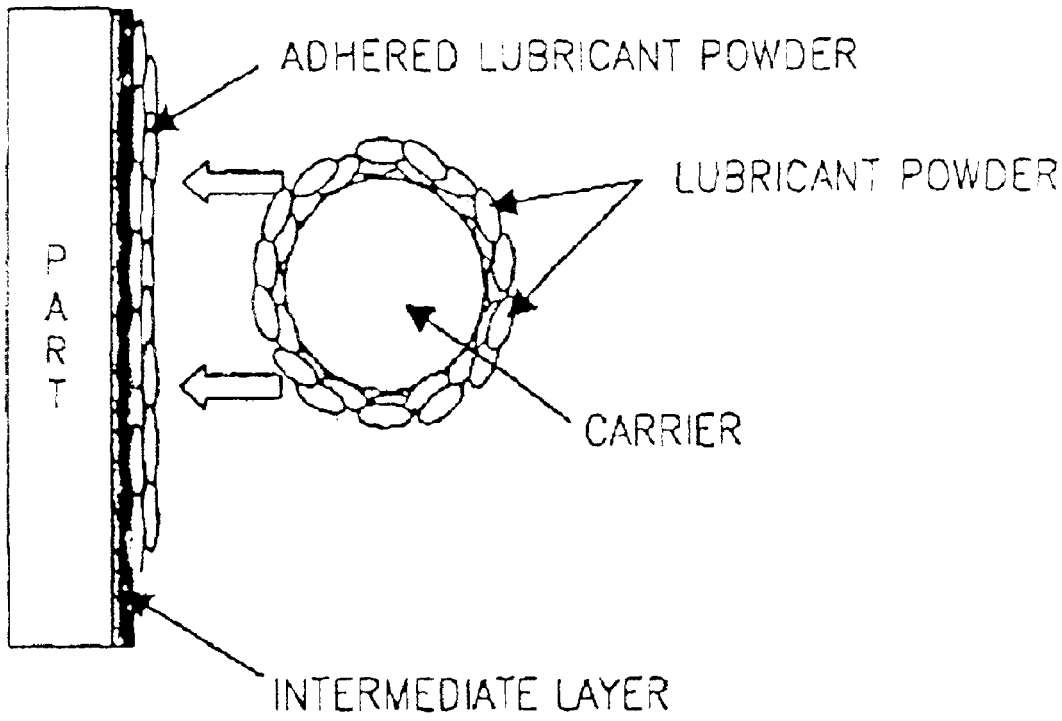
FIG. 5 illustrates the process of coating lubricant powder on a part in a method for forming a solid film lubricant according to the present invention.

The method of forming a solid film lubricant according to the present invention may be performed in a dry or wet manner. The dry formation of a solid film lubricant will be described with reference to FIG. 5.

After choosing suitable coating equipment depending on the shape and size of a target part on which a solid film lubricant is to be coated, a suitable carrier selected by considering the shape and size of the target part is poured into the coating equipment. Next, lubricant powder is put into the coating equipment containing the carrier and is thoroughly coated on the carrier by a suitable technique, such as rotation, vibration, agitation, etc.

If necessary, a common organic or inorganic binder as an auxiliary agent can be added so that the common organic or inorganic binder is deposited on the carrier along with the lubricant powder.

Next, a target part that needs a solid film lubricant is placed inside the coating equipment, and sufficient mechanical force, such as rotational., vibrational, frictional or impulsive force, is applied such that lubricant powder is penetrated and adhered to the surface of the target part.

Alternatively, the target part coated with lubricant powder may be dipped in a dilute solution of an organic or inorganic compound, followed by drying, thereby improving adhesion of the resultant solid film lubricant to the target part. In this case, it is preferable that the organic or inorganic compound has a concentration of 0.1–20 parts by weight in the dilute solution. If the concentration of the organic or inorganic compound is less than 0.1 parts by weight, there is no effect of improving adhesion of the solid film lubricant to the surface of the target part. If the concentration of the organic or inorganic compound exceeds 20 parts by weight, lubricity of the solid film lubricant is suddenly reduced, and precise control of the dimensions of a part coated with the solid film lubricant cannot be achieved due to increased thickness of the organic or inorganic compound containing film.

It is preferable that the organic or inorganic compound includes thermally resistant compounds, such as silicon resin, Teflon resin, polyamide amine resin, epoxy resin, etc.

Although the dry formation of a solid film lubricant is described above, the solid film lubricant can be formed in a wet manner. The wet method of forming a solid film lubricant now will be described.

After choosing suitable coating equipment depending on the shape and size of a target part on which a solid film lubricant is to be coated, a suitable carrier selected by considering the shape and size of the target part is poured into the coating equipment. Next, lubricant powder is put into the coating equipment containing the carrier, and a small amount of water or an organic solvent is added thereto. The lubricant powder, which is appropriately wet with water or the organic solvent, is thoroughly coated on the carrier by a suitable technique, such as rotation, vibration, friction, agitation, etc.

Next, a target part that needs a solid film lubricant is placed inside the coating equipment, and sufficient mechanical force, such as rotational, vibrational, frictional or impulsive force, is applied so that the lubricant powder appropriately wet with water or the organic solvent penetrates and adheres to the surface of the target part.

Next, the coated target part is put into a drying furnace to evaporate water or the organic solvent so that only a solid film lubricant remains on the surface of the target part.

Alternatively, water or the organic solvent used to wet lubricant powder may be replaced by a dilute solution of an organic or inorganic compound in water or the organic solvent. In this case, adhesion of the resultant solid film lubricant to a target part is improved after the drying process.

It is preferable that the organic or inorganic compound has a concentration of 0.1–20 parts by weight in the dilute solution. If the concentration of the organic or inorganic compound is less than 0.1 parts by weight, there is no effect of improving adhesion of the solid film lubricant to the surface of the target part. If the concentration of the organic or inorganic compound exceeds 20 parts by weight, lubricity of the solid film lubricant is suddenly reduced, and precise control of the dimensions of a part coated with the solid film lubricant cannot be achieved due to increased thickness of the organic or inorganic compound containing film. It is preferable that the organic or inorganic compound includes thermally resistant compounds, such as silicon resin, Teflon resin, polyamide amine resin, epoxy resin, etc.

Alternatively, an intermediate layer may be formed on the surface of the target part by plating with a soft metal capable of acting as a lubricant, such as silver, copper, tin, lead, gold, zinc, cadmium, or an alloy of these metals, or a composite alloy of a solid lubricant and these metals, before the formation of a solid film lubricant using molybdenum disulfide ($MoS_2$), tungsten disulfide ($WS_2$), graphite, polytetrafluoroethylene (PTFE), or a mixture of these compounds. In this case, the resultant solid film lubricant has improved adhesion and lubrication and can be coated on a part with a uniform thickness. When the intermediate layer is formed, the intermediate layer is preferably thermally treated at a temperature of 150–500° C. for improved ductility of the intermediate layer. The temperature of the thermal treatment is appropriately varied according to the material used for the intermediate layer. If the intermediate layer is formed of a plated tin layer, it is preferable that the thermal treatment is carried out at a temperature of 150–180° C. If the intermediate layer is formed of a plated silver layer, it is preferable that the thermal treatment is carried out at a temperature of 200–300° C.

The present invention will be described in greater detail by means of the following examples. The following examples are for illustrative purposes and are not intended to limit the scope of the invention.

EXAMPLE 1

A swash plate as a core part of a compressor for an automobile air conditioner was coated with a solid film lubricant according to the present invention.

The swash plate of a compressor compresses a refrigerant by transforming power transmitted from an engine into reciprocation of compressor pistons. As the refrigerant is highly compressed by the compressor, a higher load is applied on the surface of the rotating swash plate. When the air conditioner for vehicles is not operated, aqueous lubricant coated on the surface of the swash plate flows down off the surface of the swash plate. For this reason, the air conditioner for vehicles operates in the absence of or with insufficient aqueous lubricant for the first 30 seconds after it is turned on, thereby causing a sudden increase in coefficient of friction. Heat generation and damage of the lubricant layer caused by the increased coefficient of friction leads to galling on the swash plate.

In the present embodiment, a disc-shaped steel swash plate having a diameter of 95 mm and a thickness of 5 mm was used. The steel swash plate was plated with copper and then with silver. The vibrating barrel (b) of FIG. 2 was filled with spherical carrier particles of sintering alumina, and molybdenum disulfide ($MoS_2$) as lubricant powder was uniformly deposited on the surface of the carriers. Next, the swash plate was put into the vibrating barrel to coat a solid lubricant film thereon.

EXAMPLE 2

A solid film lubricant was coated on a swash plate in the same manner as in Example 1, except that a mixture of molybdenum disulfide and graphite powder was used as lubricant powder with which the carriers were coated.

EXAMPLE 3

A solid film lubricant was coated on a swash plate in the same manner as in Example 1, except that graphite powder was used as lubricant powder with which the carriers were coated.

EXAMPLE 4

A disc-shaped steel swash plate having a diameter of 95 mm was used. The steel swash plate was plated with copper and then with silver. The vibrating barrel (b) of FIG. 2 was filled with spherical carriers of sintering alumina, as shown in (a) of FIG. 4, and molybdenum disulfide ($MoS_2$) as lubricant powder and a small amount of water were put into the vibrating barrel to coat the surface of the carriers with the same in a wet manner. Next, the swash plate was put into the vibrating barrel to coat a wet solid lubricant film thereon, followed by a drying process.

EXAMPLE 5

A solid film lubricant was coated on a swash plate in the same manner as in Example 1, except that the swash plate was heated at a temperature of 250° C. after being plated with copper and silver.

EXAMPLE 6

A solid film lubricant was coated on a swash plate in the same manner as in Example 1, except that the swash plate coated with the solid film lubricant was dipped into a 1 part by weight dilute solution of silicon resin and dried.

EXAMPLE 7

A solid film lubricant was coated on a swash plate in the same manner as in Example 1, except that plating of the swash plate with copper and silver was not carried out so that the solid film lubricant directly contacted the steel swash plate.

The swash plates coated with solid film lubricants in Examples 1 through 7 have a glossy metallic bluish black appearance. The solid film lubricants of the swash plates have smooth surfaces with uniform thickness and good adhesion.

Comparative Example

A swash plate was processed by a conventional method in which a copper alloy used for bearings was thermal spray-coated on the surface of the swash plate that contacts shoes via which operating power is transmitted to pistons.

For the swash plates coated with solid film lubricants in Examples 1 through 4 and of the Comparative Example, oil-free, high-load, and high-speed lubricity tests were carried out.

An oil-free lubricity test is for testing lubricity in a state where lubricant oil is insufficient, i.e., as in the state where a compressor restarts after a period of non-operation. For the oil-free lubricity test, after warm-up operating the compressor for a predetermined time during which a constant load acts on shoes via which rotation of the swash plate at a low speed, and lubricant oil is not supplied, galling time, and temperature and torque variations were measured.

For the high-load lubricity test, a load acting on shoes was gradually increased while rotating the swash plate at a low speed, and galling load, and temperature and torque variations were measured.

For the high-speed lubricity test, a constant load was applied to shoes while rotating the swash plate at a high speed, and galling time, and temperature and torque variations were measured.

Figure 6A:
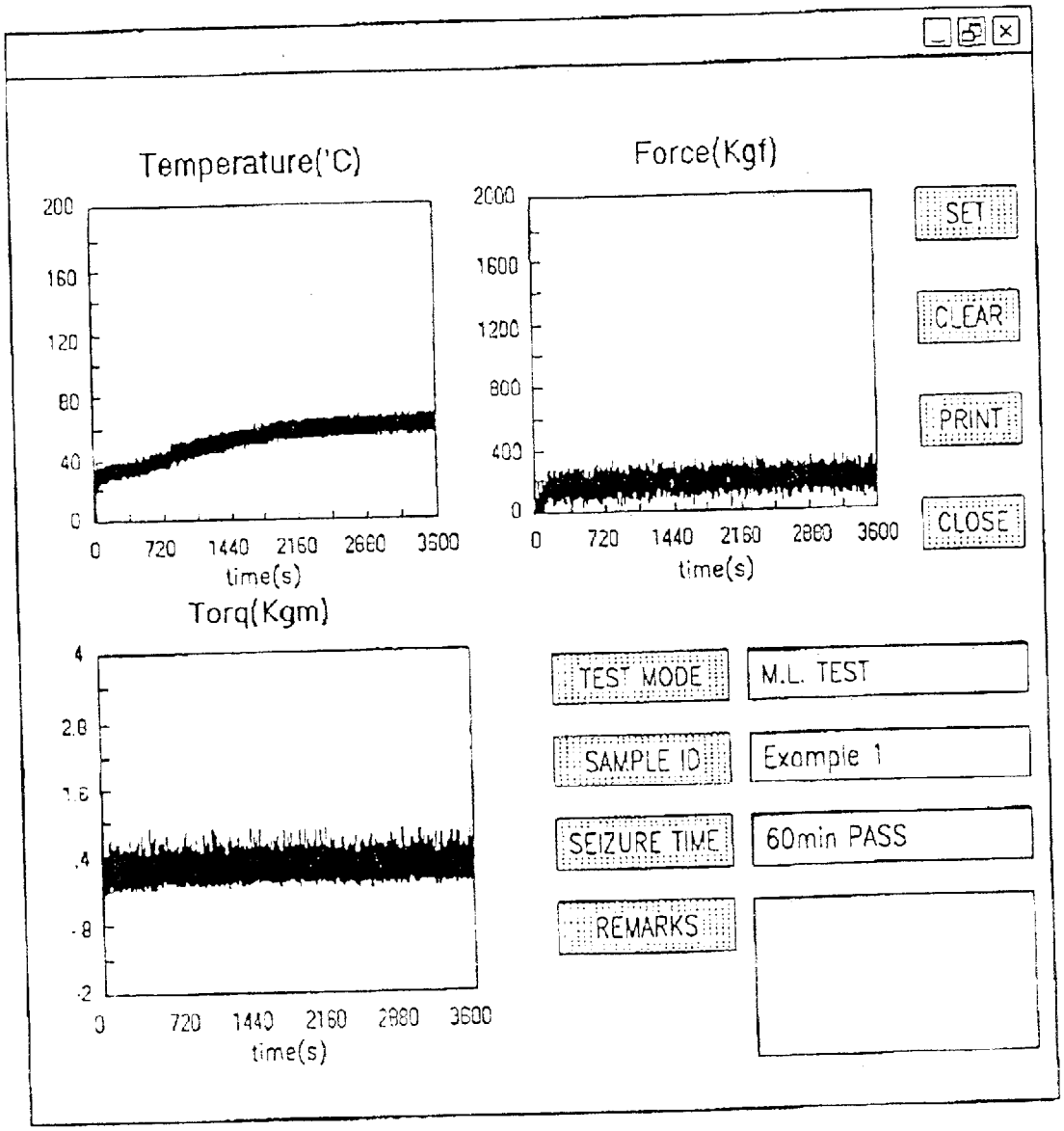
FIGS. 6A through 6C respectively show the results of oil-free, high-load, and high-speed lubricity tests for a swash plate coated with a solid film lubricant of Example 1.
Figure 6B:
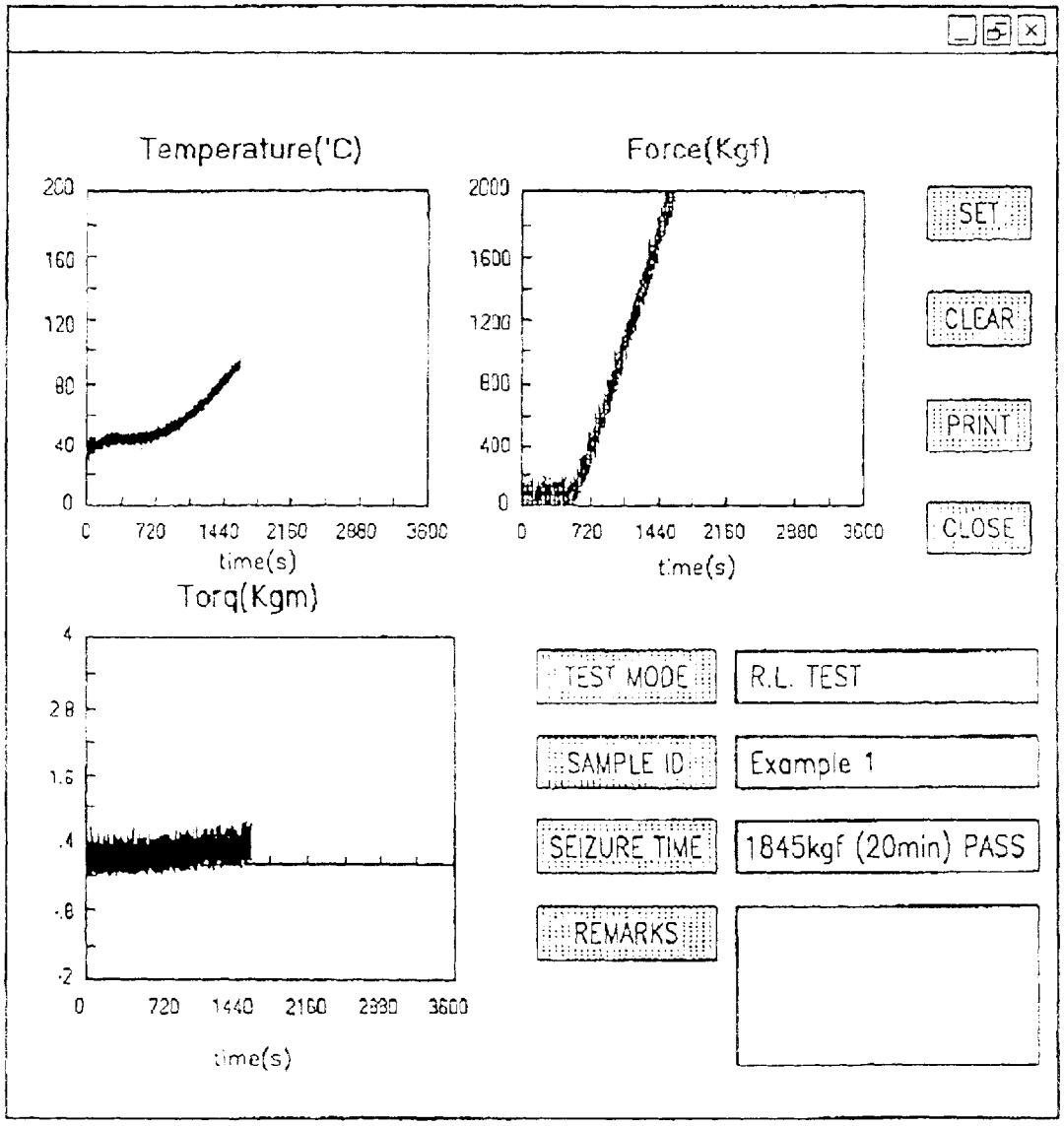
Figure 6C:
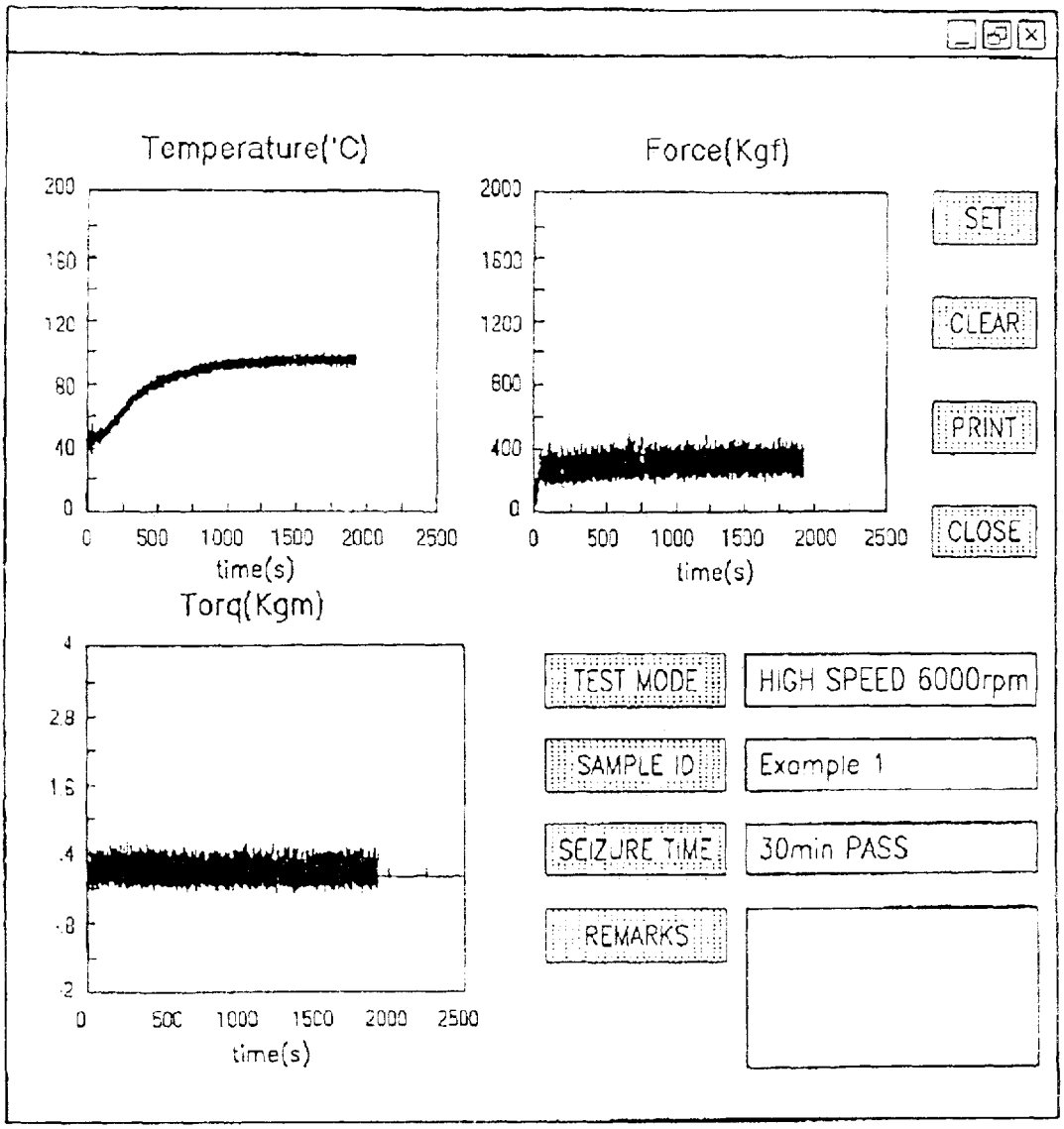
Figure 7A:
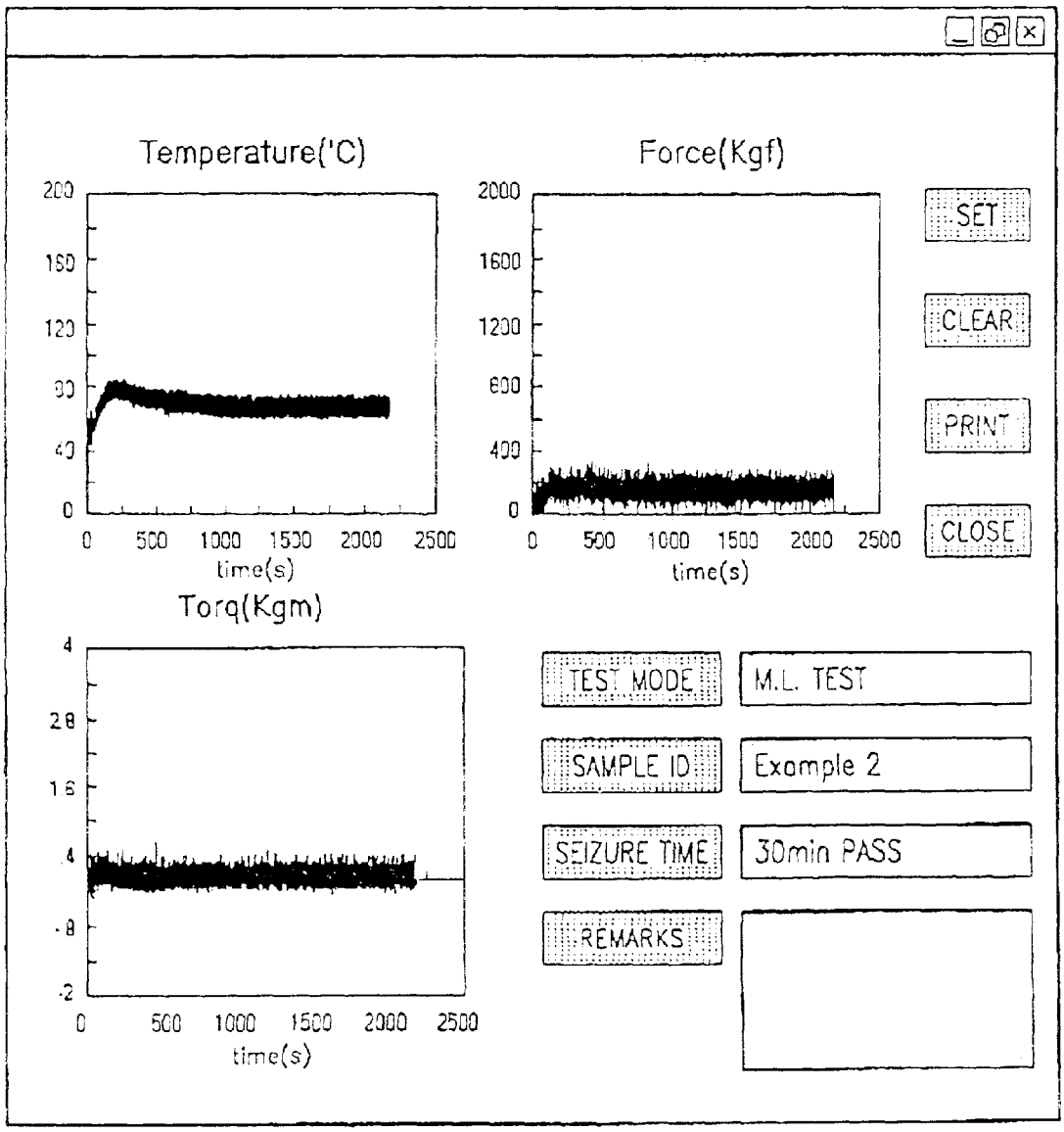
FIGS. 7A and 7B respectively show the results of oil-free and high-load lubricity tests for a swash plate coated with a solid film lubricant of Example 2.
Figure 7B:
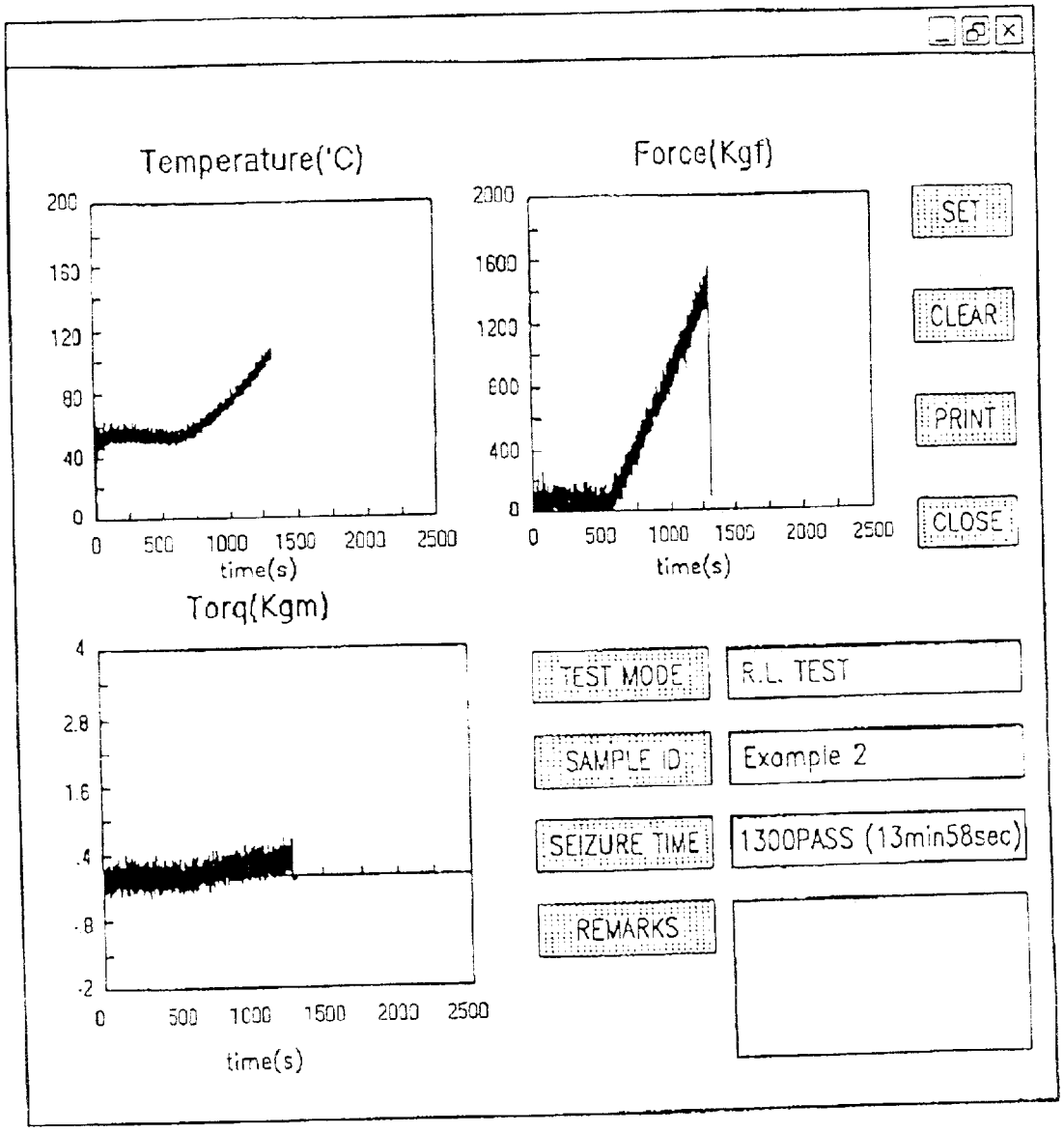
Figure 8A:
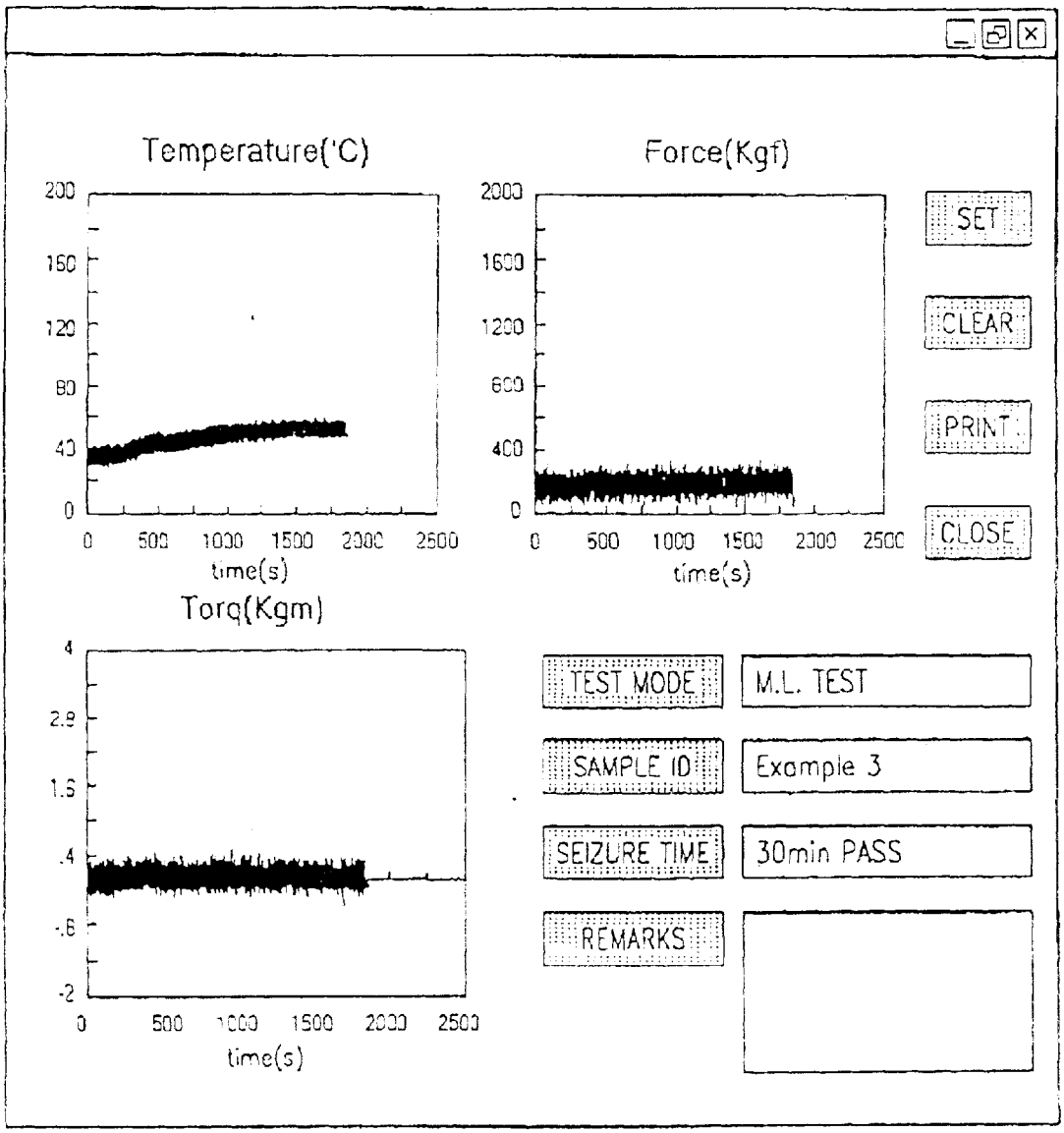
FIGS. 8A and 8B respectively show the results of oil-free and high-load lubricity tests for a swash plate coated with a solid film lubricant of Example 3.
Figure 8B:
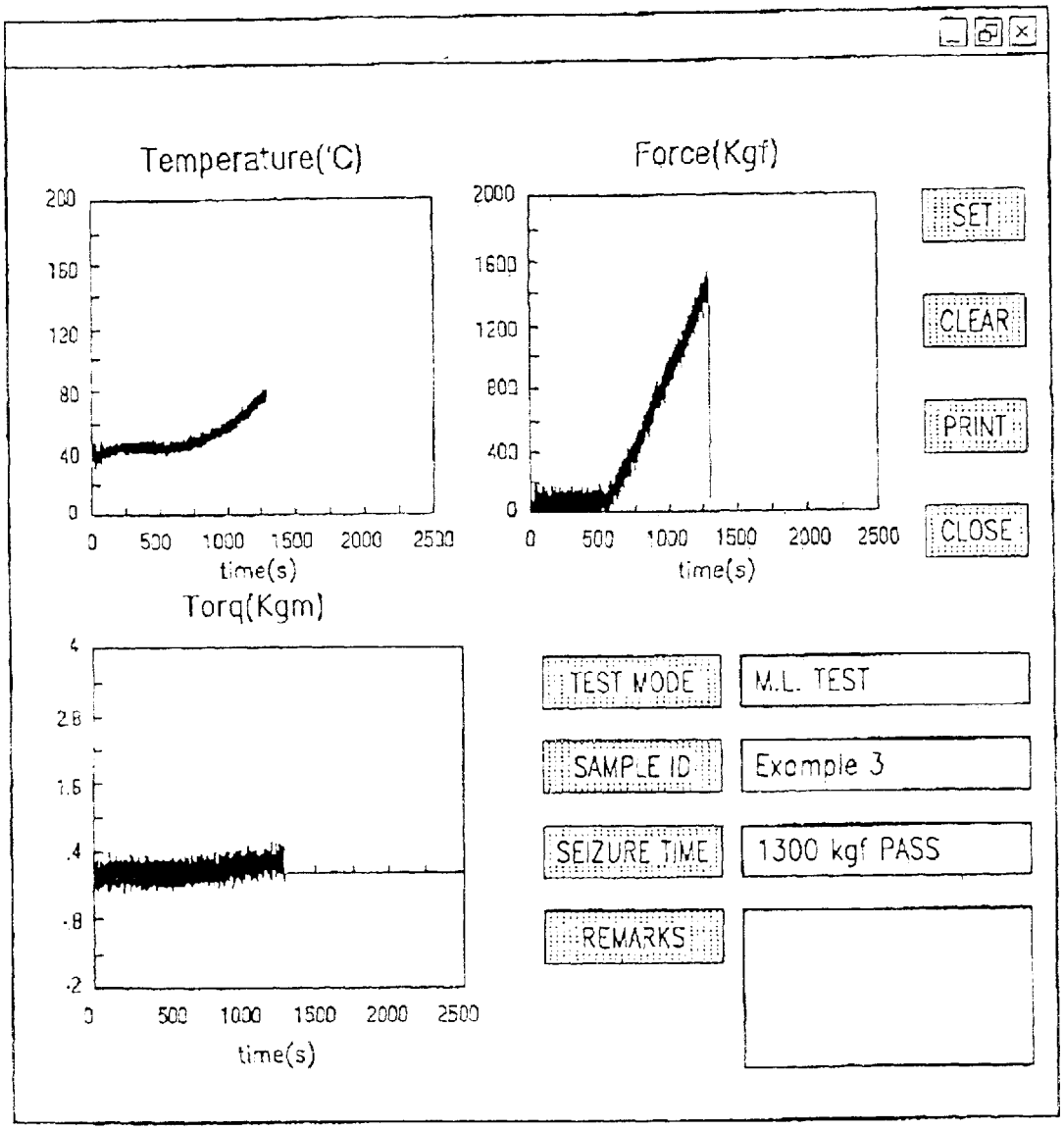
Figure 9:
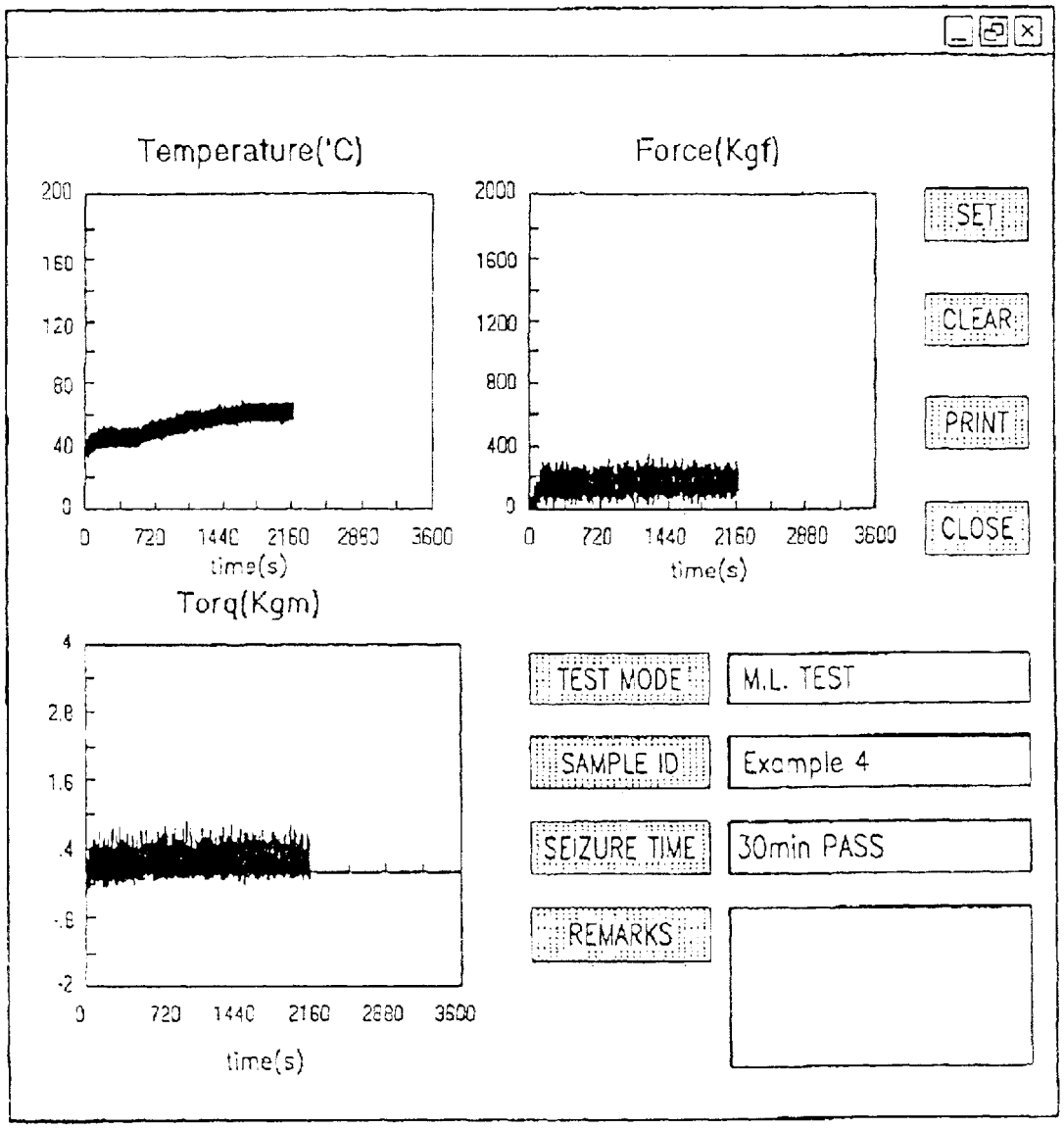
FIG. 9 shows the results of an oil-free lubricity test for the swash plate of Example 4.
Figure 10A:
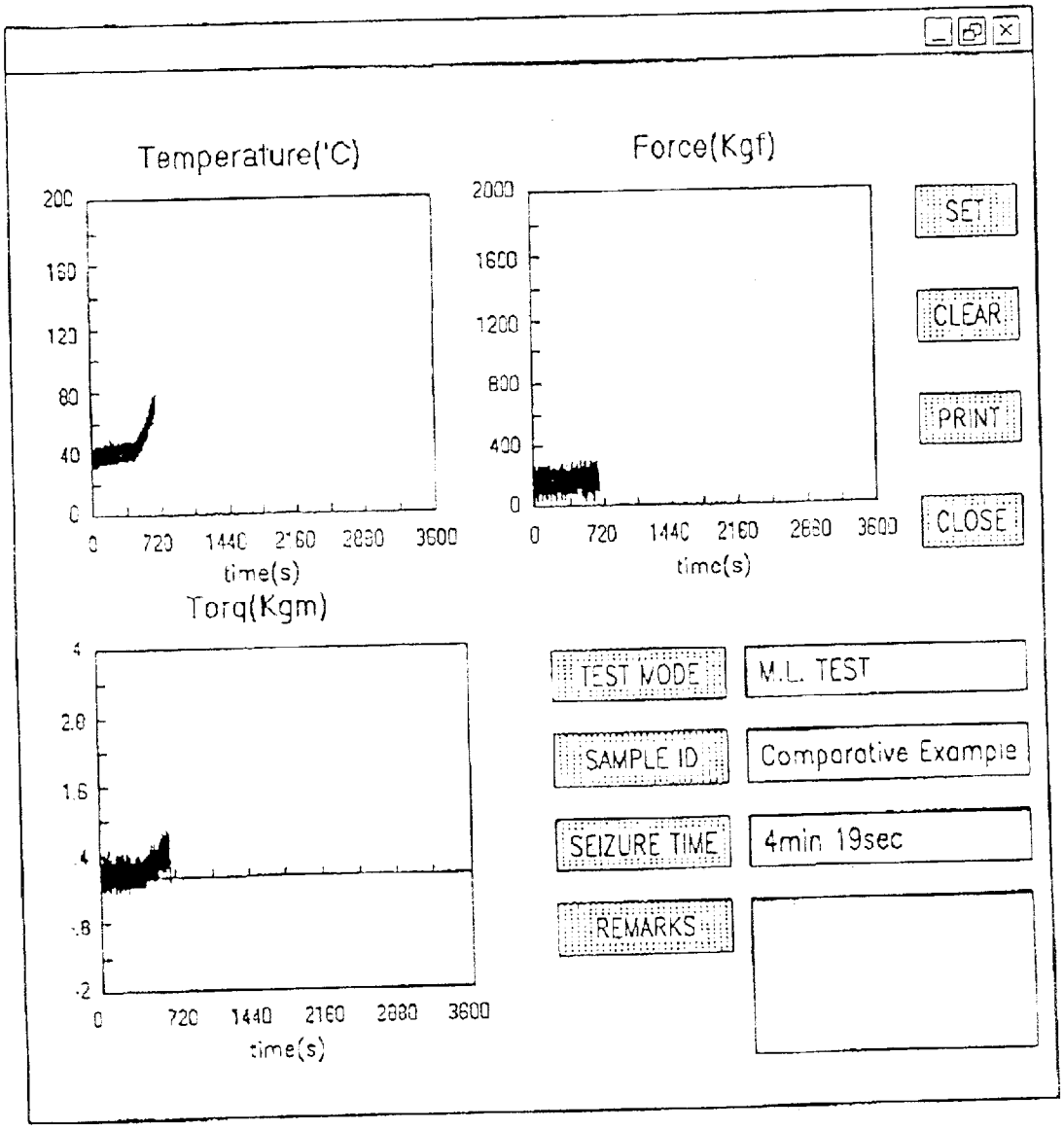
FIGS. 10A through 10C respectively show the results of oil-free, high-load, and high-speed lubricity tests for a swash plate coated with a solid film lubricant of a Comparative Example.
Figure 10B:
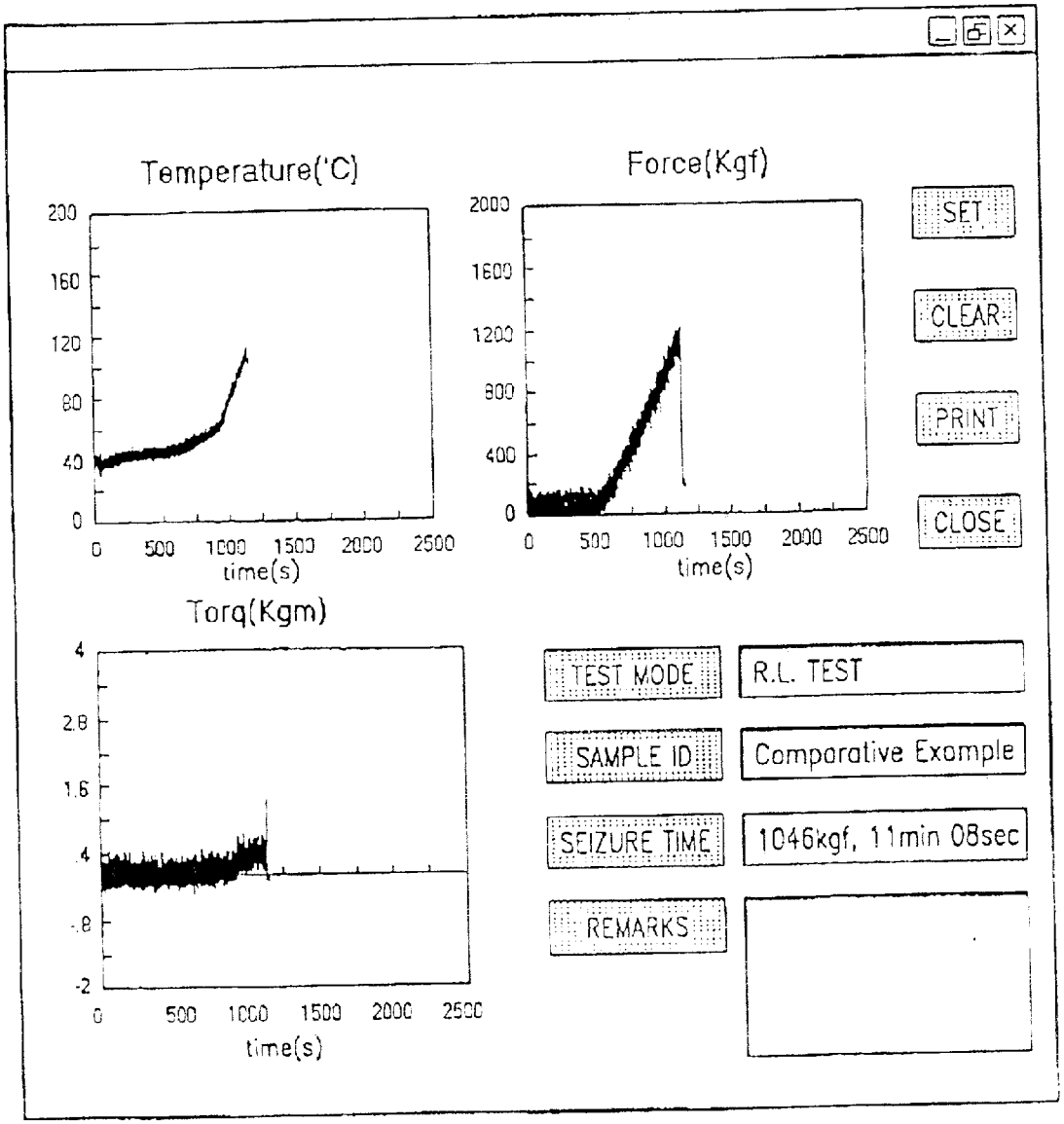
Figure 10C:
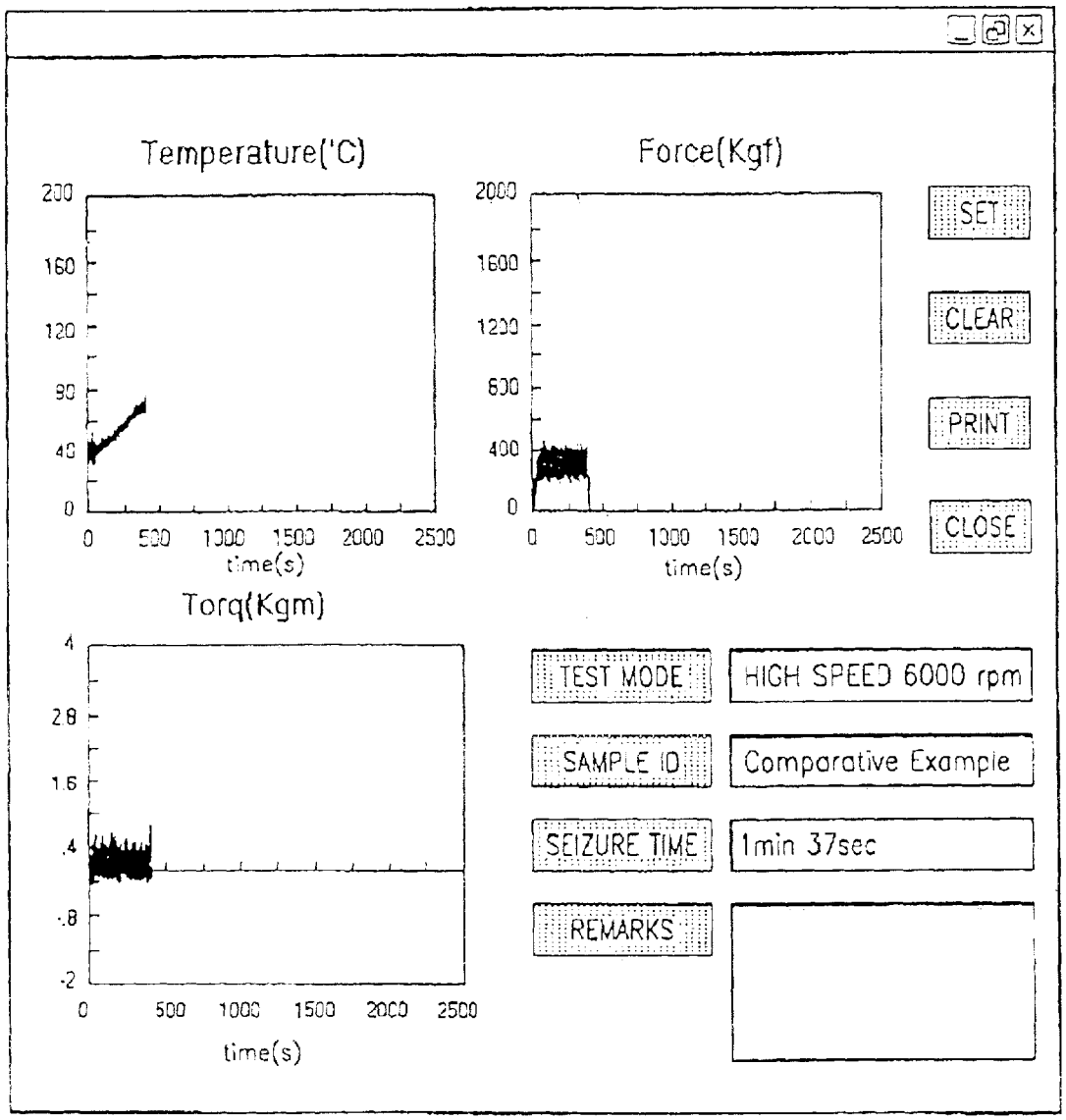

FIGS. 6A through 6C respectively show the results of oil-free, high-load, and high-speed lubricity tests for the swash plate of Example 1. FIGS. 7A and 7B respectively show the results of oil-free and high-load lubricity tests for the swash plate of Example 2. FIGS. 8A and 8B respectively show the results of oil-free and high-load lubricity tests for the swash plate of Example 3. FIG. 9 shows the results of an oil-free lubricity test for the swash plate of Example 4. FIGS. 10A through 10C respectively show the results of oil-free, high-load, and high-speed lubricity tests for the swash plate of the Comparative Example.

As a result of the oil-free lubricity test for the swash plates according to the present invention, as shown in FIGS. 6A, 7A, 8A, and 9, temperature and torque do change only very gradually for about 2,000 seconds from the start, and there is no galling. For the swash plate of the Comparative Example, as shown in FIG. 10A, after about 500 seconds, the temperature of the swash plate suddenly rises, and galling occurs. Therefore, it is ascertained that the swash plate coated with a solid film lubricant by the method according to the present invention is better lubricated with insufficient lubricant oil than the swash plate on which a conventional film lubricant is coated by thermal spraying.

For lubrication under high load, the swash plates of Examples 1, 2, and 3 are stable against a load up to 1600 kgf, and particularly up to 1845 kgf for the swash plate of Example 1, as shown in FIGS. 6B, 7B, and 8B. Meanwhile, galling occurs on the swash plate of the Comparative Example under a load of about 1200 kgf, as shown in FIG. 10B. It is evident from the results that the swash plate coated with a solid film lubricant by the method according to the present invention shows better lubrication under high load than the swash plate on which a conventional film lubricant is coated by thermal spraying.

With regard to lubricity under high-speed operation for the swash plates of Example 1 and the Comparative Example, galling occurs on the swash plate of Example 1 after about 2000 seconds, as shown in FIG. 7C. Meanwhile, the swash plate of the Comparative Example is damaged in less than 500 seconds, as shown in FIG. 10C. Therefore, lubricant effect under high-speed operation is also better for the swash plate coated with a solid film lubricant by the method according to the present invention than for the swash plate coated with a conventional film lubricant by thermal spraying.

Solid film lubricant formed by the method according to the present invention has uniform thickness and excellent adhesion regardless of the shape of a target part. Lubrication of the solid film lubricant by the method according to the present invention lasts for a longer period of time without supply of lubricant oil, and under high-load and high-speed operating conditions. Therefore, the solid film lubricant by the method according to the present invention is applicable to a variety of parts widely used in aerospace, defense, and high-precision industries.

While this invention has been particularly shown and described with reference to preferred embodiments thereof, it will be understood by those skilled in the art that various changes in form and details may be made therein without departing from the spirit and scope of the invention as defined by the appended claims.

What is claimed is:

1. A method of forming a solid film lubricant on a surface of a part, the method comprising:

preparing a carrier having a predetermined shape and size;

coating lubricant powder on the carrier, wherein an organic or an inorganic binder is coated along with the lubricant powder on the carrier; and coating the lubricant powder over the surface of the part by physical contact between the carrier coated with the lubricant powder and the part.

2. The method of claim 1, wherein the carrier coated with the lubricant powder and the part are made to physically contact each other by application of mechanical force selected from the group consisting of rotational, vibrational, frictional and impulsive forces.

3. The method of claim 1, wherein the lubricant powder comprises at least one selected from the group consisting of molybdenum disulfide ($MoS_2$), tungsten disulfide ($WS_2$), graphite, boric nitride (BN), and polytetrafluoroethylene (PTFE).

4. A method of forming a solid film lubricant on a surface of a part, the method comprising:

preparing a carrier having a predetermined shape and size;

coating lubricant powder on the carrier;

coating the lubricant powder over the surface of the part by physical contact between the carrier coated with the lubricant powder and the part;

dipping the part coated with the lubricant powder in a dilute solution of an organic or an inorganic compound; and drying the part.

5. The method of claim 4, wherein the dilute solution of the organic or the inorganic compound has a concentration of 0.1–20 parts by weight per 100 parts by weight of a solvent.

6. A method of forming a solid film lubricant on a surface of a part, the method comprising:

preparing a carrier having a predetermined shape and size;

coating lubricant powder on the carrier; and coating the lubricant powder over the surface of the part by physical contact between the carrier coated with the lubricant powder and the part;

said method further comprising forming at least one intermediate layer on the surface of the part for improved adhesion to the lubricant powder, before causing the physical contact between the carrier coated with the lubricant powder and the part.

7. The method of claim 6, wherein the intermediate layer is formed of at least one material selected from the group consisting of silver, copper, tin, lead, gold, zinc, cadmium, an alloy of these metals, and a composite alloy of a solid lubricant and these metals.

8. The method of claim 6, wherein the intermediate layer is formed by at least one method selected from the group consisting of electroplating, chemical plating, vacuum plating, thermal spraying, and physicochemical deposition.

9. The method of claim 6, further comprising heating the part with the intermediate layer at a temperature of 150–500° C. for improved ductility of the intermediate layer, after forming the intermediate layer.

10. A method of forming a solid film lubricant on a surface of a part, the method comprising:

preparing a carrier having a predetermined shape and size;

preparing a mixture of lubricant powder and a solvent;

coating the mixture on the carrier;

spreading the mixture over the surface of the part by causing physical contact between the carrier coated with the mixture and the part; and drying the part coated with the mixture;

wherein the solvent is water or a dilute solution of an organic or an inorganic compound.

11. The method of claim 10, wherein the dilute solution of the organic or the inorganic compound has a concentration of 0.1–20 parts by weight per 100 parts of a solvent.

12. A swash plate for a compressor, the swash plate being coated with the solid film lubricant formed by the method of claim 1.

13. A swash plate for a compressor, the swash plate being coated with the solid film lubricant formed by the method of claim 4.

14. A swash plate for a compressor, the swash plate being coated with the solid film lubricant formed by the method of claim 5.

15. A swash plate for a compressor, the swash plate being coated with the solid film lubricant formed by the method of claim 6.

16. The method of claim 4, wherein the carrier coated with the lubricant powder and the part are made to physically contact each other by application of mechanical force selected from the group consisting of rotational, vibrational, frictional and impulsive forces.

17. The method of claim 4, wherein the lubricant powder comprises at least one selected from the group consisting of molybdenum disulfide ($MoS_2$), tungsten disulfide ($WS_2$), graphite, boric nitride (BN), and polytetrafluoroethylene (PTFE).

18. The method of claim 6, wherein the carrier coated with the lubricant powder and the part are made to physically contact each other by application of mechanical force selected from the group consisting of rotational, vibrational, frictional and impulsive forces.

19. The method of claim 6, wherein the lubricant powder comprises at least one selected from the group consisting of molybdenum disulfide ($MoS_2$), tungsten disulfide ($WS_2$), graphite, boric nitride (BN), and polytetrafluoroethylene (PTFE).

* * * * *